US007596346B2

(12) United States Patent
Kurosu et al.

(10) Patent No.: US 7,596,346 B2
(45) Date of Patent: Sep. 29, 2009

(54) IMAGE FORMING APPARATUS INCLUDING A GUIDE FOR GUIDING A TRANSFER MATERIAL TO A TRANSFER SECTION

(75) Inventors: Shigetaka Kurosu, Hino (JP); Satoshi Nishida, Saitama (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 14 days.

(21) Appl. No.: 11/801,557

(22) Filed: May 10, 2007

(65) Prior Publication Data

US 2007/0297829 A1 Dec. 27, 2007

(30) Foreign Application Priority Data

Jun. 26, 2006 (JP) ..... 2006-174905

(51) Int. Cl.
*G03G 15/16* (2006.01)

(52) U.S. Cl. ..... 399/316; 399/388

(58) Field of Classification Search ..... 399/316, 399/388, 397, 310

See application file for complete search history.

(56) References Cited

U.S. PATENT DOCUMENTS 5,453,823 A * 9/1995 Hashizume et al. ..... 399/316
5,594,539 A * 1/1997 Murano et al. ..... 399/316
7,280,798 B2 * 10/2007 Yuminamochi ..... 399/316 X
2004/0114974 A1 * 6/2004 Sawai et al. ..... 399/316
2005/0201782 A1 * 9/2005 Fuchiwaki et al. ..... 399/316
2007/0280750 A1 * 12/2007 Kurosu et al. ..... 399/316

FOREIGN PATENT DOCUMENTS

JP 61-188345 8/1986
JP 63-73251 U 5/1988
JP 05-024708 A * 2/1993
JP 8-76607 3/1996
JP 2002226083 8/2002

OTHER PUBLICATIONS

Japanese Office Action Dated Apr. 4, 2008 with English Translation.

* cited by examiner

*Primary Examiner*—Sophia S Chen
(74) *Attorney, Agent, or Firm*—Cantor Colburn LLP

(57) ABSTRACT

An image forming apparatus including: a transfer section for transferring a toner image on an image bearing member onto a transfer material; a conveyor for conveying the transfer material to a transfer position; a first guide for forming a guiding surface in the image bearing member side on a conveyance path between the transfer position and the conveyor; and a second guide for forming a guiding surface opposed to the first guide, wherein the first guide includes a support member and a guiding member, which is supported by the support member and projected from the support member in a down stream side of a conveyance direction, the guiding member having a moving portion capable of elastically being deformed, and wherein the guiding member is formed so that a thickness of the guiding member becomes thin from an upper stream of the conveyance direction to a downstream of the conveyance direction.

8 Claims, 5 Drawing Sheets

IMAGE FORMING APPARATUS INCLUDING A GUIDE FOR GUIDING A TRANSFER MATERIAL TO A TRANSFER SECTION

This application is based on Japanese Patent Application No. 2006-174905 filed on Jun. 26, 2006, in Japanese Patent Office, the entire content of which is hereby incorporated by reference.

BACKGROUND OF THE INVENTION

The present invention relates to an image forming apparatus utilizing electrophotographic method.

In the image forming apparatus utilizing electrophotographic method, an image on an image carrier, such as a photosensitive member or an intermediate transfer member is transferred onto a transfer material, such as a paper sheet to form the image onto the transfer material. When increasing an image forming speed or minimizing the size of the apparatus, there is a problem that in the transfer position where the image is transferred, the image quality deteriorates due to the disturbance of the image caused by the vibration of the rear edge of the transfer material.

In the Japanese Patent Publications Open to Public Inspection Nos. 61-188345 and 8-76607, this problem was pointed out and the countermeasures to the problem have been proposed.

Namely, in the Japanese Patent Publication Open to Public Inspection no. 61-188345, it is proposed to provide a guide plate (a sheet having elasticity, such as PET) for softly pressing the transfer material to the transfer position in the guiding section.

In the Japanese Patent Publication Open to Public Inspection No. 8-76607, it has been proposed to fix a guiding member formed by an elastic body to the edges of a pair of guiding plates for guiding the transfer material to the transfer position and to bend the free edge of the guiding member with a predetermined angle.

The image quality deterioration caused by the vibration of the rear edge of the transfer material will be described by using FIG. 3, which illustrates the transfer section of an image forming apparatus of the embodiment of the invention and FIG. 1, which illustrates an example of image quality deterioration.

In FIG. 3, a registration roller 23 transfers a transfer material P to the transfer position TR formed by a transfer roller 7A and a support roller (an earth roller 61), and a toner image is transferred onto the transfer material P from an intermediate transfer member 6.

Numerals 30 and 31 are a pair of guiding plates for guiding the transfer material P between the registration roller 23 and the transfer position TR, the pair of guiding plates being formed by a metal plate, which is a rigid body.

When the rear edge of the transfer material P leaves from the registration roller 23, the rear edge of the transfer material leaps up and vibrates, which causes toner scattering and transfer shifts. The toner scattering is a phenomenon that dots are formed in the non-image area as shown in FIG. 1(*a*). The transfer-shift is the phenomenon that the image shifts as shown in FIG. 1(*b*). It is known that the phenomenon occurs when the rigidity of the transfer material P is high in case the transfer material P is a thick paper sheet. The suppression effect of the toner scattering and the transfer shift will be obtained by suppressing the leap-up of the rear edge of the transfer material P by providing the guiding member 32 formed by the elastic body at the front edge of the upper support member 31, namely by providing the guiding member 32 at the down stream edge of the transfer material conveyance direction, the leap up of the rear edge of the transfer material is suppressed and the suppression effect of the toner scattering and toner shift is obtained.

In recent years, as a results of that the performance of the image forming apparatus has been improved, namely as a results of the diversity of utility categories for using color documents and for forming document other than the document for office use, only the countermeasures disclosed in the Japanese Patent Applications Open to Public Inspection S61-188345 and H8-76607 are not enough. Particularly, as a result of the diversity of the kinds of the transfer materials, which are used in the image forming apparatus, when the toner image is transferred onto a thick transfer material, the transfer shits and the toner scattering caused by the leap-up of the rear edge of the transfer material become problems.

SUMMARY OF THE INVENTION

One aspect of the invention is, an image forming apparatus for forming a toner image onto a transfer material, the image forming apparatus comprising: an image bearing member; a transfer section for transferring the toner image on said image bearing member onto the transfer material; a conveyor for conveying the transfer material to a transfer position where the toner image is transferred by said transfer section; a first guide for forming a guiding surface in said image bearing member side on a conveyance path between the transfer position and said conveyor; and a second guide for forming a guiding surface opposed to said first guide, wherein said first guide comprises a support member and a guiding member, which is supported by said support member and projected from said support member in a down stream side of a conveyance direction, said guiding member having a moving portion, which is capable of elastically being deformed, and wherein said guiding member is formed so that a thickness of said guiding member becomes thin from an upper stream of the conveyance direction to a downstream of the conveyance direction.

DESCRIPTION OF THE PREFERRED EMBODIMENTS

The present invention will be described based on the embodiments of the present invention. However the present invention is not limited to the embodiments. In this specification, following sentences, such as "the front edge of the guiding plate" and "the rear edge of a transfer material" are used. In these cases, "the front edge" denotes the downstream side of the conveyance direction of the transfer material and the "the rear edge" denotes the upper-stream side of the conveyance direction of the transfer material.

Figure 1:
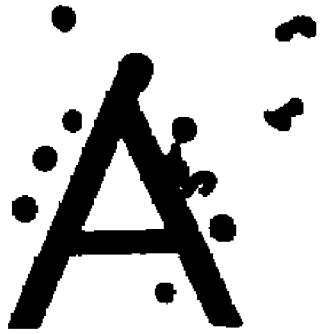
FIG. 1 illustrates an example of image quality deterioration.
Figure 1:
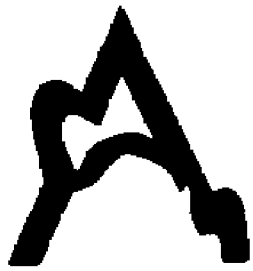
Figure 2:
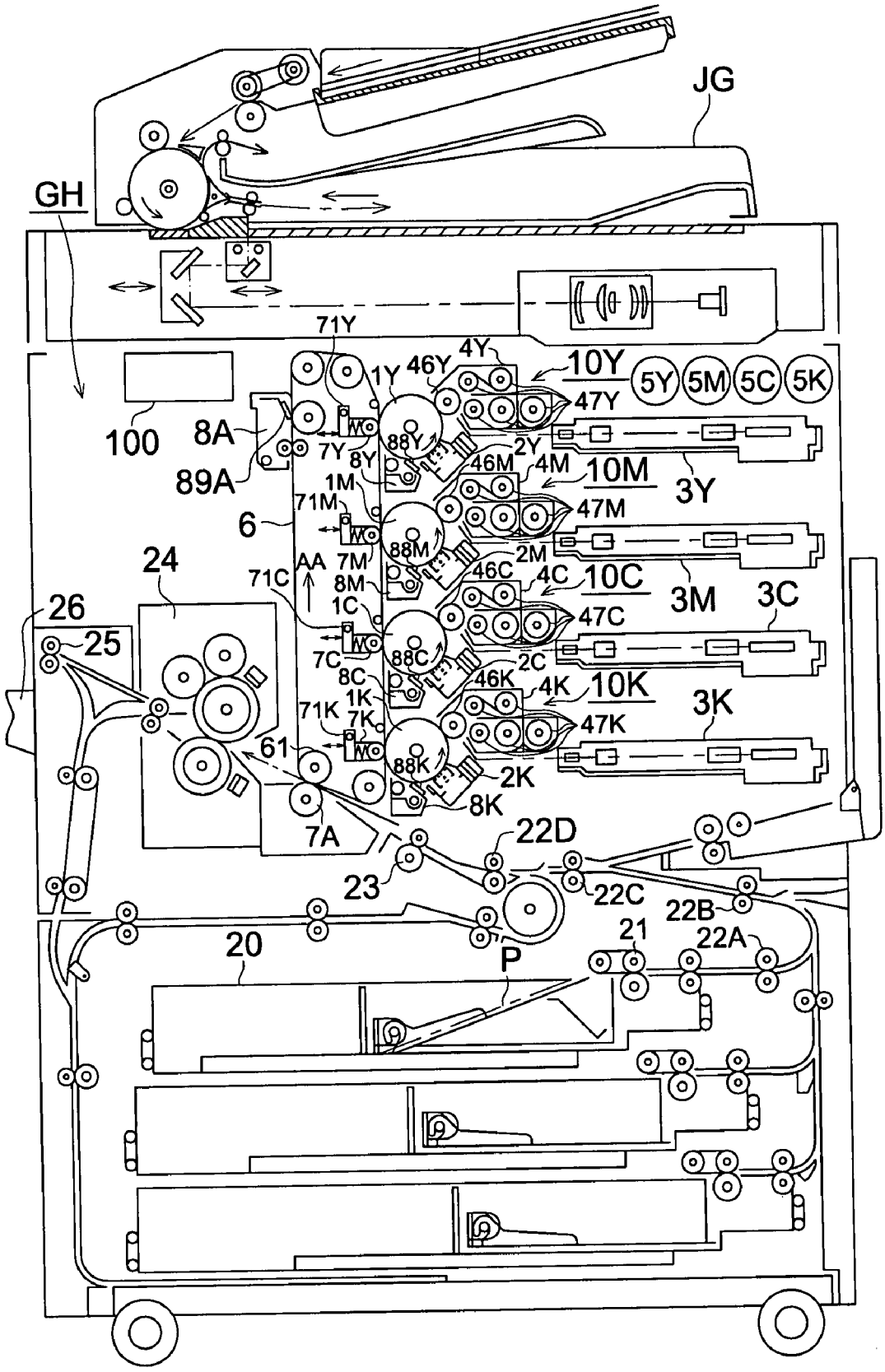
FIG. 2 illustrates a total configuration of an image forming apparatus related to an embodiment of the present invention.

FIG. 2 illustrates a total configuration of an image forming apparatus related to an embodiment of the present invention.

The image forming apparatus illustrated in FIG. 2 is a color image forming apparatus, which is capable of forming a color image. The color image forming apparatus is configured by an image forming apparatus main body GH and an automatic document feed apparatus JG provided on the image forming apparatus main body GH.

The image forming apparatus main body GH includes four image forming sections 10Y, 10M, 10C and 10K, a control section 100, an intermediate transfer member 6 shaped like a belt, a sheet feed and conveyance section, a fixing section 24 and an operation and input section (not shown). The four image forming sections 10Y, 10M, 10C and 10K are arranged in parallel along with the moving direction of the intermediate transfer member 6 shaped like a belt, the intermediate transfer member 6 being arranged to rotate in an AA direction as shown in FIG. 2. The image forming apparatus main body GH is, so called, a full color image forming apparatus of a tandem system.

The image forming section 10Y for forming a yellow color image includes a charging section 2Y, an exposing section 3Y, a developing section 4Y and a first cleaning section 8Y, which are disposed around a photosensitive member 1Y, which is an image carrier. The image forming section 10M for forming a magenta color image includes, the same as described above, a photosensitive member 1M, a charging section 2M, an exposing section 3M, a developing section 4M and the first cleaning section 8M. The image forming section 10C for forming a cyan color image includes, the same as described above, a photosensitive member 1C, a charging section 2C, an exposing section 3C, a developing section 4C and the first cleaning section 8C. The image forming section 10K for forming a black color image includes, the same as described above, a photosensitive member 1K, a charging section 2K, an exposing section 3K, a developing section 4K and the first cleaning section 8K. The charging section 2Y and the exposing section 3Y, the charging section 2M and the exposing section 3M, the charging section 2C and the exposing section 3C, and the charging section 2K and the exposing section 3K respectively configure electro-static latent image forming sections. 5Y, 5M, 5C and 5K denote toner containers respectively storing yellow toner, magenta toner, cyan toner and black toner. The toner is supplied correspond to the toner consumed in the developing sections 4Y, 4M, 4C and 4K from these toner containers.

The photosensitive members 1Y, 1M, 1C and 1K are respectively OPC photosensitive members having negatively charged particles, the OPC photosensitive members being formed as an OPC photosensitive layers on the surface of the metal drams. The photosensitive members other than the OPC photosensitive members, such as aSi photosensitive member may be used as the photosensitive members 1Y, 1M, 1C and 1K. It is also possible to use photosensitive member having positively charged particles. Encoders (not shown), which output a plus in every one rotation, are respectively provided onto the photosensitive members 1Y, 1M, 1C and 1K. The control section 100 is arranged to respectively detect the outputs to count the number of rotations of the photosensitive member 1Y, 1M, 1C and 1K.

A corotron discharger and a scorotron discharger may be used as the charging sections 2Y, 2M, 2C and 2K. A wire-type discharger or a saw shaped electrode discharger may also be used as the charging sections 2Y, 2M, 2C and 2K.

The exposing section 3Y has a semiconductor laser as a light source, which exposes the photosensitive member per a dot unit by using a laser beam based on yellow image data. The same as above, the exposing section 3M exposes the photosensitive member 1M by using a laser beam based on magenta image data, the exposing section 3C exposes the photosensitive member 1C by using a laser beam based on cyan image data and the exposing section 3K exposes the photosensitive member 1K by using a laser beam based on black image data. A LED array or the exposing section other than the laser beam, such as a liquid crystal may be used as the exposing sections 3Y, 3M, 3C and 3K. However, it is preferable that the exposure is conducted per a dot unit.

The developing sections 4Y, 4M, 4C and 4K respectively have openings against the photosensitive members 1Y, 1M, 1C and 1K and include developing image carriers 46Y, 46M, 46C and 46K. A plurality of stirring screws 47Y, 47M, 47C and 47K for supplying stirred development agent to the developing agent carriers 46Y, 46M, 46C and 46K while stirring and conveying the development agent, the stirring screws 47Y, 47M, 47C and 47K being arranged to be shaped in a cylindrical style and to be capable of rotating. The toner replenished from the toner containers 5Y, 5M, 5C and 5K is supplied to the developing agent carriers 46Y, 46M, 46C and 46K while being stirred by the stirring screws 47Y, 47M, 47C and 47K.

With respect to the developing agent, either of the two ingredients developing agent including toner and carriers or one ingredient developing agent including toner but not carriers may be used.

The developing sections 4Y, 4M, 4C and 4K may be a reversed development system for adhering toner onto the exposing area or a normal developing system for adhering toner to non-exposing area. The developing sections 4Y, 4M, 4C and 4K may be either a contact developing system or a non-contact developing system. As described above, the system, which has been known, may be used as the developing sections 4Y, 4M, 4C and 4K. However, the two ingredient developing agent using a reversed developing system is preferable.

The cleaning sections 8Y, 8M, 8C and 8K respectively include rubber cleaning blades 88Y, 88M, 88C and 88K as the first cleaning members formed in the longitudinal direction of the photosensitive members 1Y, 1M, 1C and 1K. The surfaces of the photosensitive members 1Y, 1M, 1C and 1K are scrubbed to be cleaned up when the photosensitive members 1Y, 1M, 1C and 1K are rotated under the condition that the edges of cleaning blades 88Y, 88M, 88C and 88K contact with the surface the photosensitive members 1Y, 1M, 1C and 1K.

The intermediate transfer member 6 as an image carrier is formed by an endless belt having a semiconductor characteristic having a resister value of $10^5\Omega$-$10^{10}\Omega$, which is put up over a plurality of rollers including an earth roller 61. The intermediate transfer member 6 is supported so as to be capable of rotating and moving. The intermediate transfer member 6 is rotated and moved by the signals to the driving section (not shown) of the intermediate member from the control section 100.

The images of the respective colors formed by the image forming sections 10Y, 10M, 10C and 10K are sequentially transferred onto the intermediate transfer member 6, which is called the first transfer, and a synthesized color image is formed by applying the first transfer output, which has an opposite polarity against, onto the first transfer sections 7Y, 7M, 7C and 7K and forming a transfer electric field, under the condition that the first transfer sections 7Y, 7M, 7C and 7K are pressed and contacted with the intermediate transfer member 6, which is rotating and moving.

The first transfer sections 7Y, 7M, 7C and 7K are basically released by a press release sections 71Y, 71M, 71C and 71K except when the image is formed, and the first transfer sections 7Y, 7M, 7C and 7K are away from the intermediate transfer member 6. The first transfer sections 7Y, 7M, 7C and 7K are pressed to the intermediate transfer member 6 by the press release sections 71Y, 71M, 71C and 71K before the toner image, into which an image has been formed, reaches to an intermediate transfer position. The selection of press or release is changed and controlled by the output from the control section 100 to the press release sections 71Y, 71M, 71C and 71K.

The first transfer outputs are respectively supplied to the first transfer sections 7Y, 7M, 7C and 7K from the first transfer output applying sections (not shown), which are respectively power sources. With respect to the control method of the first transfer outputs, which are inputted to the first transfer sections, there are two methods, (1) a constant current method for setting a predetermined target current value and controlling the transfer current to be the target current value and (2) a constant voltage method for setting a predetermined target voltage value and controlling the transfer voltage to the target voltage value. In (1), the current value becomes the first transfer output and in (2) the voltage value becomes the first transfer value. In this embodiment, the constant current method of (1) has been reduced to practice and the current value is set as the first transfer output. The control section 100 controls the first transfer outputs, which are the current values, and the input timings to the first transfer sections 7Y, 7M, 7C and 7K by the signals to the first transfer output applying section. When forming an image in a normal situation, the first transfer output is set at 30 μA so that the transfer rate becomes 100%.

With respect to the first transfer section, a semiconductor roller having the resister value of $10^5\Omega$-$10^{10}\Omega$ is preferably used.

Respective color toners remaining on the surfaces of the photosensitive members 1Y, 1M, 1C and 1K after having conducted the first transfer onto the intermediate transfer member 6 are cleaned by the cleaning blades 88Y, 88M, 88C and 88K, which are the first cleaning members.

The transfer material P stored in a paper sheet feeding cassette 20 of a sheet feed and conveyance section is conveyed to the second transfer section 7A via paper sheet feeding rollers 22A, 22B, 22C, 22D and the registration roller 23 after the transfer material P is fed by a paper sheet feeding section 21 of the sheet feed and conveyance section. The color image is secondary transferred onto the transfer material P at once. A fixing section 24 conducts a fixing process of the color image onto the transfer material P, to which the color image has been transferred. The transfer material P is nipped by an eject rollers 25 and placed onto an eject tray 26 provided the outside of the apparatus.

On the other hand, after transferring the color image onto the transfer material P by the transfer section 7A, the intermediate transfer member 6, from which the transfer material P is separated, is cleaned up by the second cleaning section 8A having a rubber cleaning blade 89A, which is the second cleaning member formed along the width direction of the intermediate transfer member 6.

Figure 3:
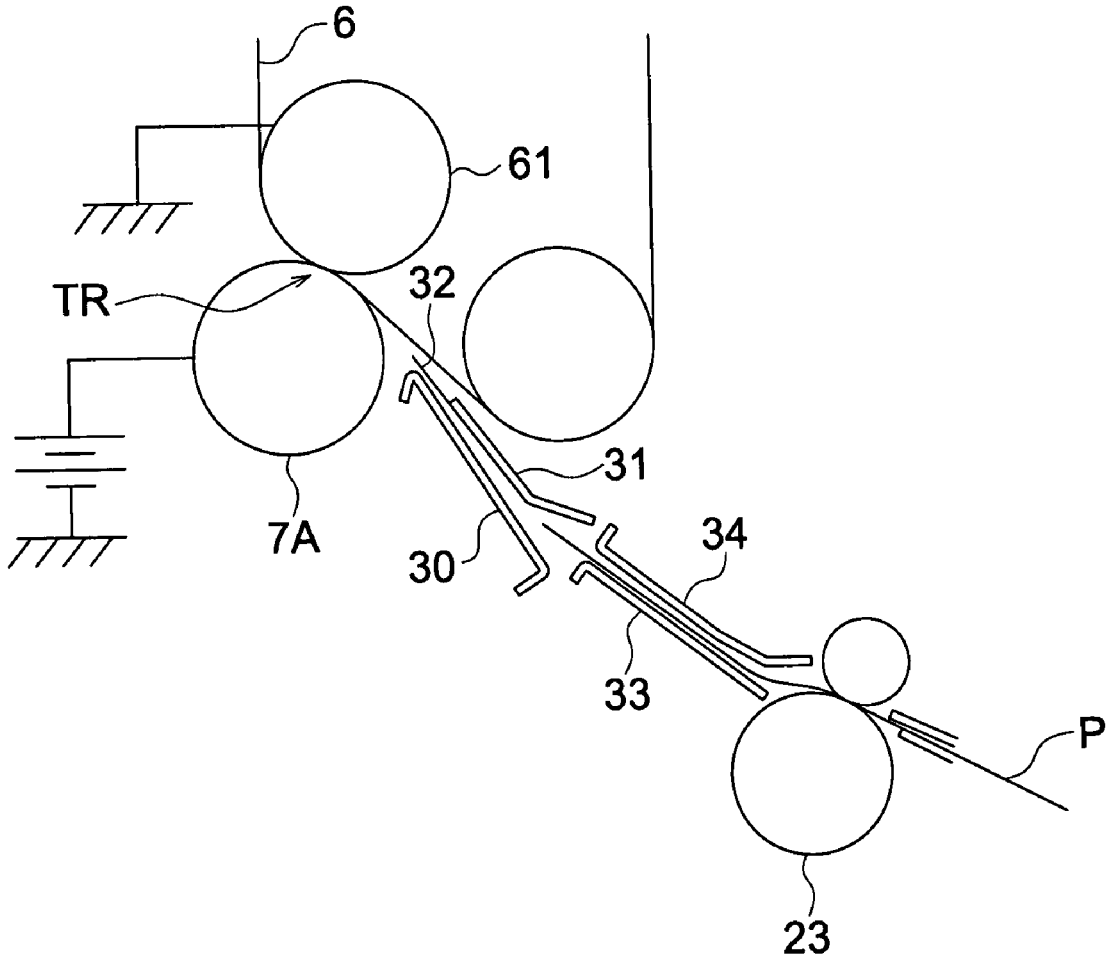
FIG. 3 illustrates the second transfer section in the image forming apparatus illustrated in FIG. 2.

FIG. 3 illustrates the second transfer section in the image forming apparatus illustrated in FIG. 2.

The transfer material P is conveyed by the registration roller 23 as a conveyor to the transfer position TR formed by the second transfer section 7A structured by the transfer roller, to which the transfer voltage is applied, and the earth roller 61. Then the toner image is transferred onto the transfer material P from the intermediate transfer member 6. The intermediate transfer member 6 and the transfer roller 7A form transfer nip at the transfer position TR. A sheet is nipped and conveyed by the intermediate transfer member 6 and the transfer roller 7A and the toner image is transferred on the sheet.

Numerals 30 and 31 structure a pair of guiding section between the registration roller 23 and the transfer position TR, which is structured by a metal sheet. Numeral 30 denotes a guiding plate for guiding the transfer material. Numeral 31 denotes a support member for supporting the guiding member 32. In the example illustrated in FIG. 3, numeral 31 also has a function as a guiding plate for guiding the transfer material P.

Numerals 33 and 34 denote guiding plates for forming the conveyance path in the upper stream of the support member 31, the guiding path being structured by a metal plate.

Numeral 32 denotes the guiding member, the base of which is fixed onto the front edge of the support member 31 structured by an elastic sheet of resin, such as PE (Polyethylene) and PET (Polyethylene Terephthalate), or rubber. The guiding member 32 is preferably a conductive material or a material, which has been processed not to be frictionally charged.

The support member 31 and the guiding member 32 structure the first guiding section forming a guiding surface in the intermediate transfer member 6 side (an image carrier side) on the conveyance path located between the registration roller 23 and the transfer position TR. The guiding plate 30 structures the second guiding section forming the guiding surface opposed to the first guiding section.

As described above, the guiding member 32 structured by an elastic body suppresses toner scattering and transfer shift. However, this suppression effect is not uniform across the various kinds of transfer material P. It has become clear that there is a case that the image deterioration cannot be prevented by simply providing the guiding member 32 when the transfer material P having a high rigidity.

For example, when conducting transfer by using a paper sheet having a basis weight of 350 gsm by using the guiding member 32 capable of preventing the image deterioration for a paper sheet having basis weight of 200 gsm, since the rigidity of the guiding member becomes insufficient and the vibration cannot be relieved, toner scattering and transfer shift occur.

When using the guiding member 32 capable of preventing the image deterioration against the paper sheet having a basis weight of 350 gsm, since the rigidity of the guiding member is excessive, the rear edge of the transfer material vibrates, and toner scattering and transfer shifts occur.

When the image carrier is a belt, the vibration of the rear edge of the transfer material transmits to the image carrier and the image quality further deteriorates.

Particularly, when the intermediate transfer member is an image carrier, since the intermediate transfer member is conductive, the charges of toner image leak via the intermediate transfer member and the absorbent force of the intermediate transfer member to the toner image becomes low. Thus, the toner image becomes easy to move on the intermediate transfer member and the image quality easily deteriorates.

In this embodiment, providing the guiding member 32 as described below has solved these problems.

Figure 4:
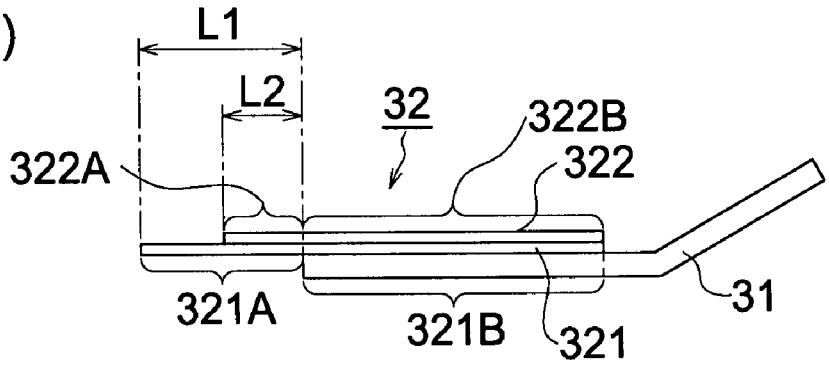
FIGS. 4(*a*) to 4(*e*) illustrates several examples of the guiding member 32.
Figure 4:
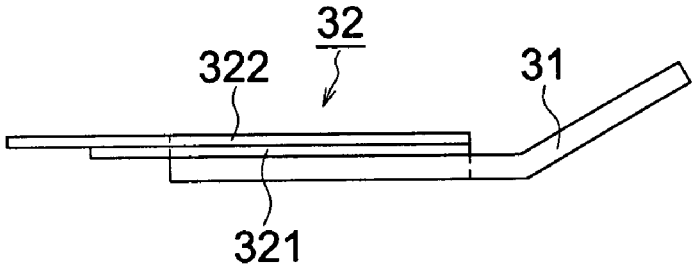
Figure 4:
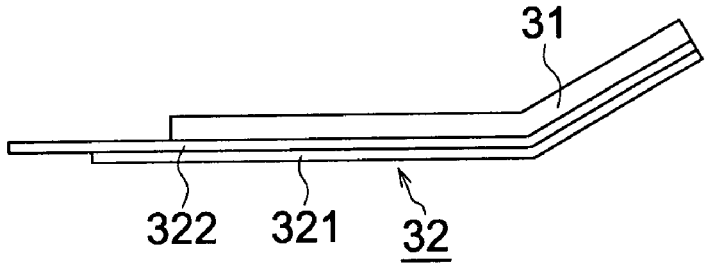
Figure 4:
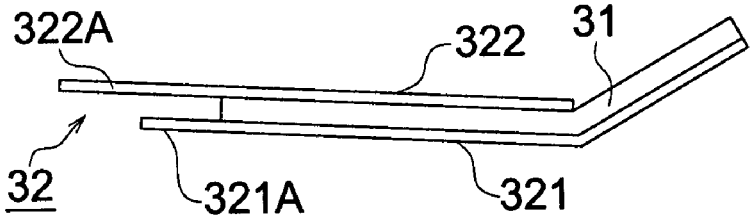
Figure 4:
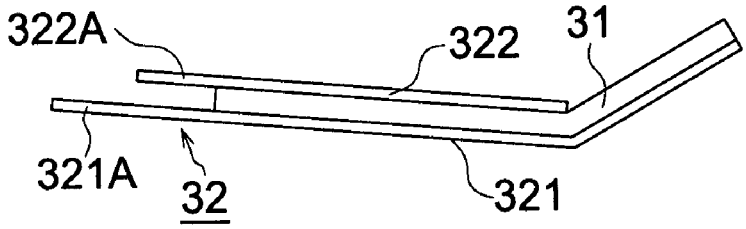

FIGS. 4(*a*) to 4(*e*) illustrate several examples of the guiding member 32.

FIG. 4(*a*) illustrates the structure of the guiding member 32, which is structured by layering two elastic sheets 321 and 322 so that the thickness decreases along from the upper stream toward the downstream of the conveyance direction of the transfer material.

The bases 321B and 322B of the elastic sheets 321 and 322 are attached onto the support member 31 by an adhesion and the front edge portions 321A and 322A structure a moving section, which are not regulated by the support member 31. The length L1 of the moving portion 321 A of the elastic sheet 321, which is a far side from the image carrier, is formed so as to be longer than the length L2 of the elastic sheet 322. Based on this structure, when the outside force caused by the leap of the transfer material P is received, the nearer to the front edge of the guiding member 32, the more deformed the guiding member 32 is, and the shock is relieved.

The length of L1 of the moving section 321A is preferably set at 4-6 mm and the length L2 of the moving section 322A is set at 2-5 mm.

When using the elastic sheet having a uniform thickness as the guiding member 32, and selecting the thickness of the guiding member 32 based on a firm transfer material, the shock relief action of the guiding member 32 becomes insufficient, the vibration of the rear edge of the transfer material occurs, and toner scattering and transfer shits occur. When selecting the thickness of the guiding member 32 based on a weak-knead transfer material in case conveying the firm transfer material, the guiding member 32 is largely deformed and toner scattering and transfer shifts occur due to the shock of the deformation.

In the image forming, in which various kinds of transfer materials having various kinds of stiffness or firmness are used, satisfactory transformation becomes possible by setting the thickness of the guiding member 32 so that thickness becomes thinner toward the front end (downstream of the conveyance direction) from the base (upper stream of the conveyance direction) of the guiding member 32.

The stiffness or firmness of the transfer material P mainly depends of the rigidity of the transfer material P. However, the stiffness or firmness of the transfer material P also depends on the size of the transfer material P. Namely, even though the transfer material has the same rigidity, the transfer material having a large size and a wide width has a firm characteristic in the stiffness or firmness.

FIG. 4(*b*), the same as FIG. 4(*a*), illustrates an example of the guiding member 32 having a structure, in which two elastic sheets are layered. In this example, the length L2 of moving section of the elastic sheet 322, which is located in the near side to the image carrier, is arranged to be longer than the length of L1 of the moving section of the elastic sheet 321, which is located in a far side of the image carrier.

FIG. 4(*c*) illustrates an example, in which the guiding member 32 is adhered onto the surface opposite to the surface facing to the image carrier of the support member 31.

FIG. 4(*d*) illustrates an example, in which the elastic sheets 321 and 322 are adhered onto both surfaces of the support member 31 to form the guiding member 32. In this example, the length of the moving section 322A of the elastic sheet 322, which is located in the near side to the image carrier is arranged to be loner than the length of the moving section 321A of the elastic sheet 321, which is located in the opposite side.

FIG. 4(*e*), the same as the FIG. 4(*d*), illustrates an example, in which the elastic sheets 321 and 322 are adhered onto both sides of the support member 31. The respective lengths of the moving sections 321A and 322B are opposite to the example shown in FIG. 4(*d*).

Figure 5:
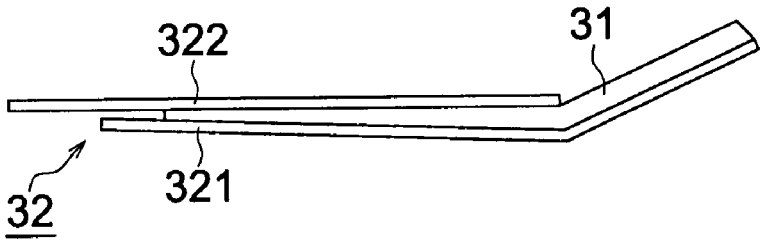
FIGS. 5(*a*) to 5(*f*) illustrates several examples of the guiding member 32.
Figure 5:
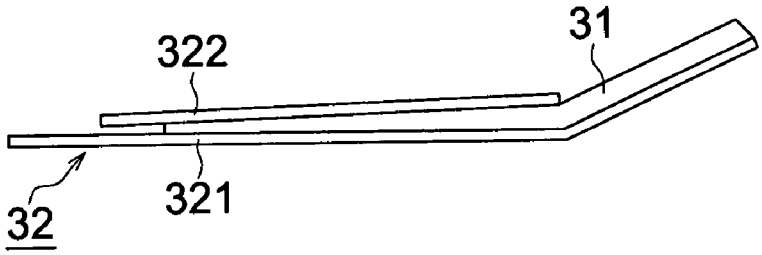
Figure 5:
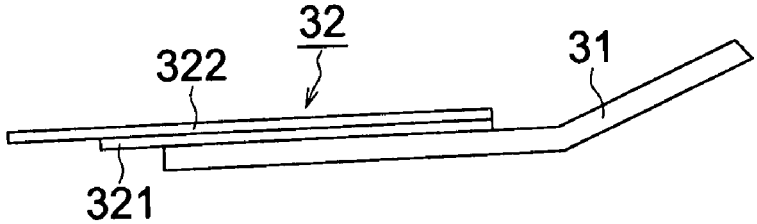
Figure 5:
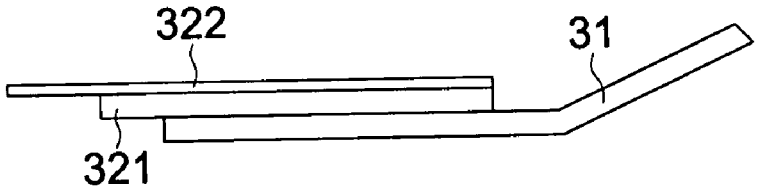
Figure 5:
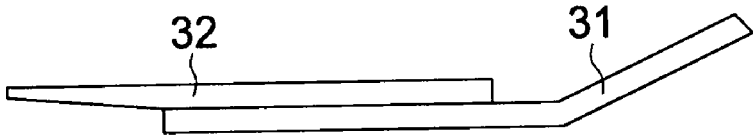
Figure 5:
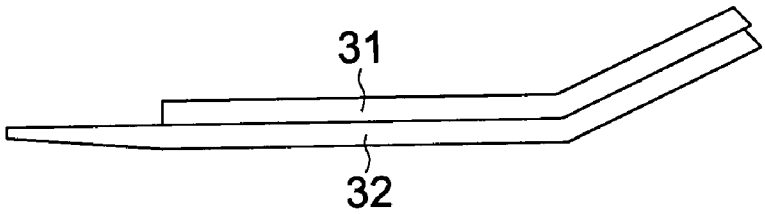

FIGS. 5(*a*) and 5(*b*) illustrate examples, in which the front edge of the support member 31 is formed to be thinner so that the front edges of the elastic sheets 321 and 322 come to closer toward the front edges of the elastic sheets 321 and 322.

FIG. 5(*c*) illustrates an example of the guiding member 32 structured by a plurality of elastic sheets 321 and 322 formed of different materials. In FIG. 5(*c*), the moving section 321A is structured by a short elastic sheet 321 of PET, and the moving section 322A is structured by a long elastic sheet 322 of PE. In the example shown in FIG. 5(*c*), it is preferable that a low rigidity material is used to form a longer elastic sheet 322 and a high rigidity material is used to form a shorter elastic sheet 321. Based on these examples, it becomes possible to improve the vibration suppression effect for various kinds of transfer material.

FIG. 5(*d*) illustrates an example of the guiding member structured by a plurality of elastic sheets 321 and 322 having different thickness. In this case, the same as the example shown in FIG. 5(*c*), the same vibration suppression effect can be obtained. When setting the thickness of the shorter elastic sheet 321 thicker, the rigidity of the elastic sheet 322 also becomes higher and a satisfactory vibration suppression effect can be obtained.

FIGS. 5(*e*) and 5(*f*) illustrate examples of the guiding member 32, in which the thickness is shaped thinner toward the front edge of the guiding member 32. FIG. 5(*e*) illustrates an example, in which the guiding member 32 is adhered onto the surface of the support member 31, which is located in a near side to the image carrier. FIG. 5(*f*) illustrates an example, in which the guiding member 32 is adhered onto the surface of the support member 31, which is located in a far side to the image carrier.

Within the examples shown in FIGS. 4(*a*) to 4(*e*) and 5(*a*) to 5(*f*), in the examples shown in FIGS. 4(*a*), 4(*b*), 5(*c*), 5(*d*) and 5(*e*), the support member 31 and the guiding member 32 form the guiding surface of first guiding section. In FIGS. 4(*c*), 4(*d*), 4(*e*), 5(*a*), 5(*b*) and 5(*f*), the support member does not form the guiding surface and only the guiding member 32 forms the guiding surface of the first guiding section.

An image forming experimental results, in which a black image formation has been continuously conducted under the condition that the conveyance speed of the transfer media including four kinds of transfer media having different paper sheet thicknesses (basis weights) is set at 220 mm/sec, will be shown in Table 1.

In Table 1, relative example 1 shows the results obtained when the PET sheet having uniform thickness of 50 μm is used as the guiding member; relative example 2 shows the results obtained when the PET sheet having uniform thickness of 100 μm is used as the guiding member; and the embodiment shows results obtained when PET sheets having thickness of 50 μm are layered, the front edges of the PET sheets being shifted each other so that the lengths of moving sections become respectively 5 mm and 3.5 mm to form the guiding member and adhered to the support member. The length of the moving section in the relative examples 1 and 2 is set at 5 mm.

TABLE 1

| | Paper sheet thickness | | |
|---|---|---|---|
| Basis weight (gms) | Relative example 1 One sheet of PET Thickness 50 μm | Relative example 2 One sheet of PET Thickness 100 μm | Embodiment Two sheets of PET Thickness 50 μm |
| 200 | A | C | A |
| 256 | B | C | A |
| 300 | C | B | A |
| 350 | C | A | A |

In Table 1, "A" denotes that a satisfactory image is formed; "B" denotes that a little toner scattering has been observed; and "C" denotes that notable toner scattering has been observed.

According to the results shown in Table 1, it is clear that in the relative examples where a guiding member having a uniform thickness is used, in case of relative example 1, when the basis weight is relatively low and a transfer material has a relatively low rigidity, image deterioration does not occur. However, when the basis weight is relatively high and the transfer material has a relatively high rigidity, the image deterioration occurs.

In case of relative example 2 where a guiding plate having a high rigidity is used, when the basis weight is relatively high and a transfer material has relatively high rigidity, image deterioration does not occur. However, when the basis weight is relatively low and the transfer material has a relatively low rigidity, the image deterioration occurs.

On the contrary, in the embodiment, satisfactory image has been formed for all kinds of paper sheets.

As described above, according to the embodiment, even when transferring a toner image onto transfer materials having largely different variations in firmness, toner scattering and transfer shifts can be sufficiently suppresses and a high quality image can be steadily formed.

What is claimed is:

1. An image forming apparatus for forming a toner image onto a transfer material, the image forming apparatus comprising:

an image bearing member;

a transfer section for transferring the toner image on said image bearing member onto the transfer material;

a conveyor for conveying the transfer material to a transfer position where the toner image is transferred by said transfer section;

a first guide for forming a guiding surface in said image bearing member side on a conveyance path between the transfer position and said conveyor; and a second guide for forming a guiding surface opposed to said first guide, wherein said first guide comprises a support member and a guiding member, which is supported by said support member and projected from said support member in a down stream side of a conveyance direction, said guiding member having a moving portion, which is capable of elastically being deformed, and wherein said guiding member is formed so that a thickness of said guiding member becomes thin from an upper stream of the conveyance direction to a downstream of the conveyance direction, wherein said guiding member comprises a plurality of elastic sheets having different length.

2. The image forming apparatus of claim 1, wherein the elastic sheets are attached onto a surface of said support member by an adhesion.

3. The image forming apparatus of claim 1, wherein the elastic sheets are adhered onto both surfaces of said support member.

4. The image forming apparatus of claim 1, wherein at least one elastic sheet of the plurality of elastic sheets is formed of a material different from a material of the other elastic sheet of the plurality of elastic sheets.

5. The image forming apparatus of claim 1, wherein said image bearing member is shaped like a belt.

6. The image forming apparatus of claim 5, wherein said image bearing member is an intermediate transfer member on which a toner image is transferred from a photosensitive member.

7. The image forming apparatus of claim 5, wherein said transfer section comprises a transfer roller, and the transfer roller and said image bearing member forms a transfer position.

8. The image forming apparatus of claim 7, wherein said image bearing member and the transfer roller are configured to convey the transfer material.

* * * * *